US009895006B1

(12) United States Patent
Howell

(10) Patent No.: US 9,895,006 B1
(45) Date of Patent: Feb. 20, 2018

(54) BABY AND TODDLER CARE AND TRANSFER PAD

(71) Applicant: Erin Noel Howell, San Diego, CA (US)

(72) Inventor: Erin Noel Howell, San Diego, CA (US)

( * ) Notice: Subject to any disclaimer, the term of this patent is extended or adjusted under 35 U.S.C. 154(b) by 0 days.

(21) Appl. No.: 15/231,925

(22) Filed: Aug. 9, 2016

Related U.S. Application Data

(63) Continuation-in-part of application No. 13/437,641, filed on Apr. 2, 2012, now abandoned.

(60) Provisional application No. 61/516,224, filed on Mar. 31, 2011.

(51) Int. Cl.
*A47D 13/08* (2006.01)
*A47D 5/00* (2006.01)
*A47D 13/02* (2006.01)

(52) U.S. Cl.
CPC ..... *A47D 13/083* (2013.01); *A47D 5/00* (2013.01); *A47D 13/02* (2013.01)

(58) Field of Classification Search
CPC .... A47D 15/003; A47D 13/08; A47D 13/083; A47D 9/005; A47D 1/103; B60N 2/2833; B60N 2002/2896; B60N 2/2811; A61G 1/00; A61G 1/01; A61G 1/013; A61G 1/044
See application file for complete search history.

(56) References Cited

U.S. PATENT DOCUMENTS 3,986,505 A * 10/1976 Power ..... A61F 17/00 128/846
4,124,908 A * 11/1978 Burns ..... A61F 5/3776 2/69.5
4,891,454 A * 1/1990 Perdelwitz, Jr. ..... B60N 2/2812 297/219.12
5,285,797 A * 2/1994 Zeller ..... A61F 5/3776 128/869
5,366,271 A * 11/1994 Johnston ..... B60N 2/286 297/250.1
6,367,427 B1 * 4/2002 Canady ..... A61F 5/05825 119/857
2001/0048235 A1 * 12/2001 Hartranft ..... B62B 3/1444 297/219.12
2003/0000017 A1 * 1/2003 Byerrum ..... A61G 1/01 5/625
2004/0088794 A1 * 5/2004 Calkin ..... A61G 1/01 5/628
2006/0076812 A1 * 4/2006 Ward ..... B60N 2/2881 297/250.1
2008/0295250 A1 * 12/2008 Helt, III ..... A61G 1/00 5/625
2010/0096419 A1 * 4/2010 Stephens ..... A47D 13/02 224/153
2011/0046588 A1 * 2/2011 Jensen ..... A61F 13/15 604/360
2011/0248532 A1 * 10/2011 Kim ..... A47C 7/748 297/180.11

(Continued)

*Primary Examiner* — Eric J Kurilla
(74) *Attorney, Agent, or Firm* — Thomas Van Zandt

(57) ABSTRACT

Systems and methods according to the principles described here provide a safe, Comfortable, and soft pad which may be used for the care of babies and toddlers. The pad may be used during care and to transfer babies or toddlers from one location to another without waking the child. The pad includes handles which may be actual handles or hole handles to allow a caregiver to securely grasp pad in order to safely transfer the child.

1 Claim, 3 Drawing Sheets

(56) References Cited

U.S. PATENT DOCUMENTS

| | | | | |
|---|---|---|---|---|
| 2012/0272451 | A1* | 11/2012 | Haskell | A61G 1/01 5/628 |
| 2012/0286549 | A1* | 11/2012 | Fair | B62B 9/108 297/219.12 |
| 2014/0053335 | A1* | 2/2014 | Calkin | A61G 1/044 5/628 |
| 2015/0283006 | A1* | 10/2015 | Akins | A61G 1/01 5/628 |

* cited by examiner

BABY AND TODDLER CARE AND TRANSFER PAD

CROSS REFERENCE TO RELATED APPLICATIONS

This application claims priority from the following related applications. This application is a continuation-in-part of U.S. patent application Ser. No. 13/437,641 entitled "Baby and Toddler Care and Transfer Pad" filed on Apr. 2, 2012 which claims priority from U.S. Provisional Patent Application No. 61/516,224, entitled "Keepasleep 3-in-1 Baby Pad", filed on Mar. 31, 2011.

BACKGROUND

Numerous products exist for babies and toddlers to sleep on or rest on while nursing. These products are generally bulky and are not conducive to moving or transferring a baby from one resting place to another.

Conventional products for assisting sleep include swaddling blankets. Such products may assist in getting a child to steep, while thicker sleeping pads may be necessary to provide an adequate sleeping environment. These products are not helpful in moving a sleeping baby or toddler to another location or transferring the sleeping baby or toddler to a different sleep environment, for example from a car seat to a bed. This is very inconvenient to the caregiver and disturbing to the baby.

SUMMARY

The pad assembly according to one embodiment of the invention described here includes a thick, comfortable and soft pad with structural integrity. The pad can be safely and conveniently grasped by handles which may be attached to and extend from the edge of the pad. Additionally, or alternatively, the handles may hole handles, which are holes or apertures completely through the pad allowing the caregiver to hold the pad and baby by putting their hands through the hole handles. This helps reduce the disturbance to the baby when being moved.

In one implementation, the pad assembly may be used for nursing, feeding, and/or packing the child to sleep. Unlike prior devices for this purpose, the pad assembly eliminates the hole between the body and arms of the caregiver, creating a more comfortable nursing or bottle-feeding experience for both the caregiver and the recipient. During a nursing session with the mother, the pad also doubles as a blanket and further may be used as a nursing cover while in use.

In yet another implementation, the pad assembly may be used as a "transfer pad". In this fashion, upon the baby or toddler falling asleep on the pad assembly, the caretaker may then comfortably and securely transfer the sleeping baby or toddler to another resting place, while minimizing the waking of the child due to the disruption during the transfer.

In yet a further implementation, the pad assembly is convenient to use as a diaper changing pad to keep the baby or toddler comfortable and clean while changing their diaper.

In one aspect, the invention is directed towards a pad assembly for caring for and transferring a baby or toddler, including: a body section configured for supporting a body of a baby or toddler, the body section having a shape of a substantially rectangular solid having a body width, a body depth, and a body length; and a head section configured for supporting a head of a baby or toddler, the head section having a head width, a head depth, and a head length, such that the head width and head length are less than the body width and body length, respectively.

Implementations of the invention may include one or more of the following. The head thickness made equal or be greater than the body thickness. The head section may be in the shape of a trapezoid. The body section may define a hole structured and configured for access of a buckle in a baby or toddler car seat. The pad assembly may further include at least two holes defined in the body section, the two holes disposed on opposite sides of the body width. The two hides may be disposed at a location on the body depth within 25% from a center of mass of a combined body and head section. The pad assembly may further include at least two holes defined in a combined body and head section, one hole defined at a proximal end of the head section and one hole defined at a distal end of the body section. The body section and the head section may be made of a foam solid coveted with a cloth or polymer substance. The body section and the head section may be made of batting covered with cloth. The thickness of the body section and the head section may be between one and four inches. The width of the head section may be between 10 and 21 inches. The length of the combined body section and head section may be between 35 and 40 inches. The pad assembly may further include a hole cover to protect the defined holes from ingress by a hand of a baby or toddler. The hole cover may be attached to the body section or head section by Velcro or buttons. The pad assembly may further include an extension body section adapted to lengthen the body section.

In another aspect, the invention is directed towards a method of making a pad assembly, the pad assembly for caring for and transferring a baby or toddler, including: manufacturing a pad insert having a pad body section configured for supporting a body of a baby or toddler, the pad body section having a shape of a substantially rectangular solid having a body width, a body depth, and a body length, the pad further including a pad head section configured for supporting a head of a baby or toddler, the pad head section having a head width, a head depth, and a head length, such that the pad head width and head length are less than the pad body width and body length, respectively; and covering the pad with a protective covet.

Implementations of the invention may include one or more of the following. The pad insert may be made of foam, batting, polyester, synthetic materials, cotton, wool or blends or combinations of these. The protective cover may made of one or more of the following: cotton, fleece, hemp, polyester, bamboo, terry, flannel velour, polyester fleece, minkee, suedecloth, Sherpa, wool, polyurethane laminate, vinyl or water resistant-proof type of materials, moisture wicking fabrics.

In another Aspect, the invention is directed towards a method of making a pad assembly, the pad assembly for caring for and transferring a baby or toddler, including: manufacturing a cloth cover having a cover body section configured for supporting a body of a baby or toddler, the cover body section substantially in a shape of a rectangular solid and having a width, a depth, and a length, the cover further including a head section configured for supporting a head of a baby or toddle, the cover having a width, a depth, and a length, such that the head width and head length are less than the body width and body length, respectively; and filling the cloth cover with material selected from the group including: batting, foam, polyester, synthetic materials, cotton, wool or blends or combinations of these.

Advantages of the invention may include one or more of the following. A variety of types of children, including, e.g., infants, babies, toddlers, and the like, can benefit from implementations described here according to present principles. In addition, caregivers, especially nursing mothers but also fathers and other caretakers, may benefit from the convenience of the described implementations. Such is particularly true for caregivers that bottlefeed, breastfeed, or rock babies to sleep. In addition, systems and methods according to the principles described here allow for the transfer of a baby or toddler from one location to another without waking the child or while minimizing the waking of the child during the transfer, no matter whether the making was from a temperature change from a parent's arms to a cold sheet or from typical movement and jostling during transfer. The pad assemblies described here address multiple problems and solve such problems with a single easy-to-use device.

BRIEF DESCRIPTION OF THE DRAWINGS

Like reference numerals refer to like elements throughout.

DETAILED DESCRIPTION

Figure 1:
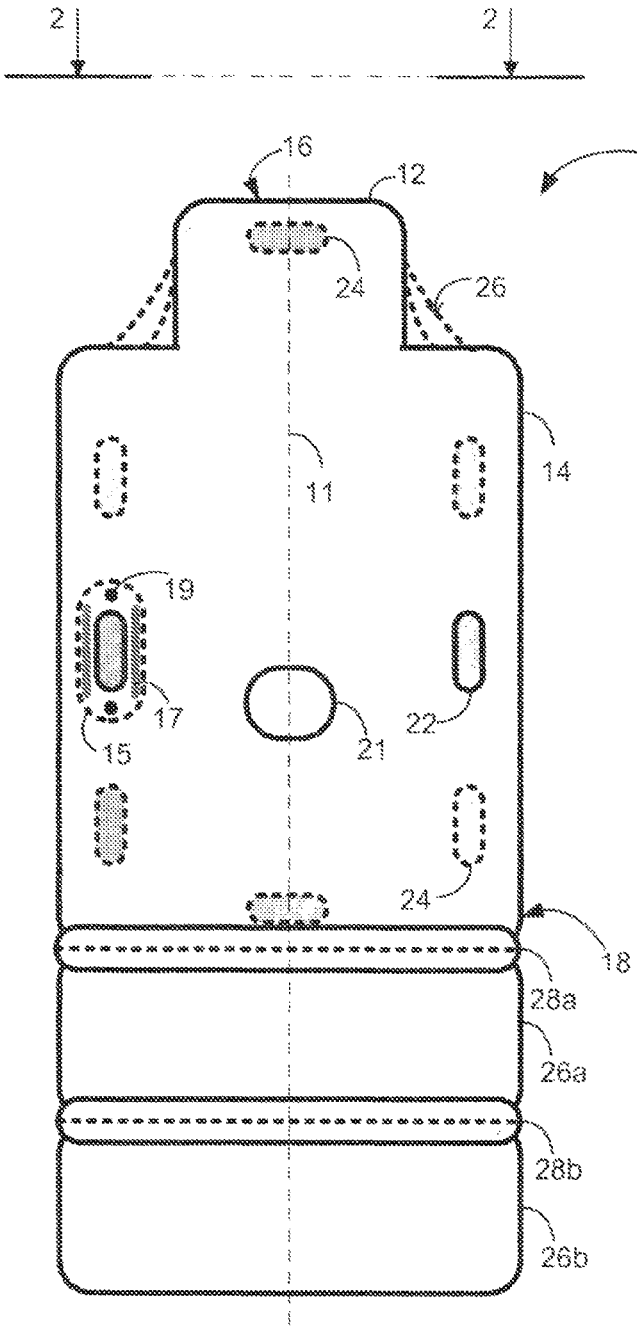
FIG. 1 illustrates a schematic depiction of a care and transfer pad assembly according to one implementation of the principles described here.
Figure 3:
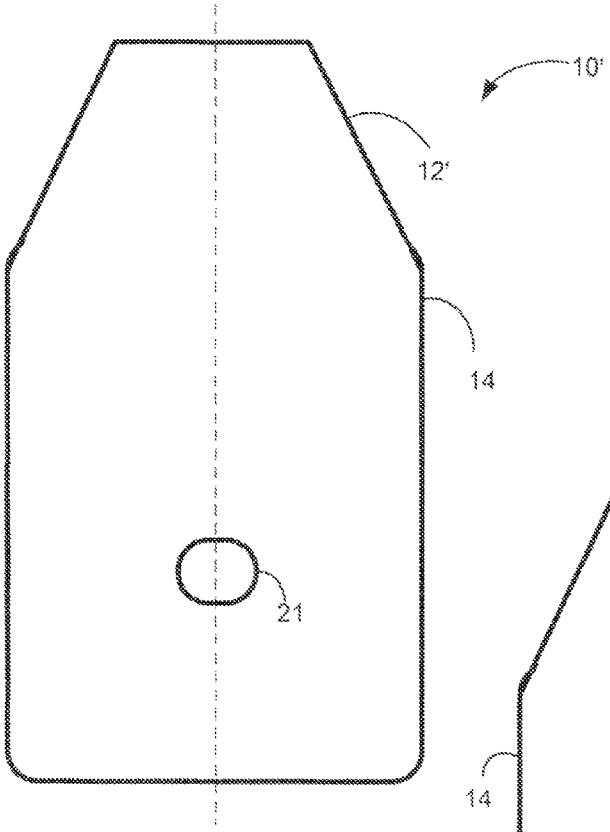
FIG. 3 illustrates a schematic depiction of a care and transfer pad assembly according to another implementation of the principles described here.
Figure 4:
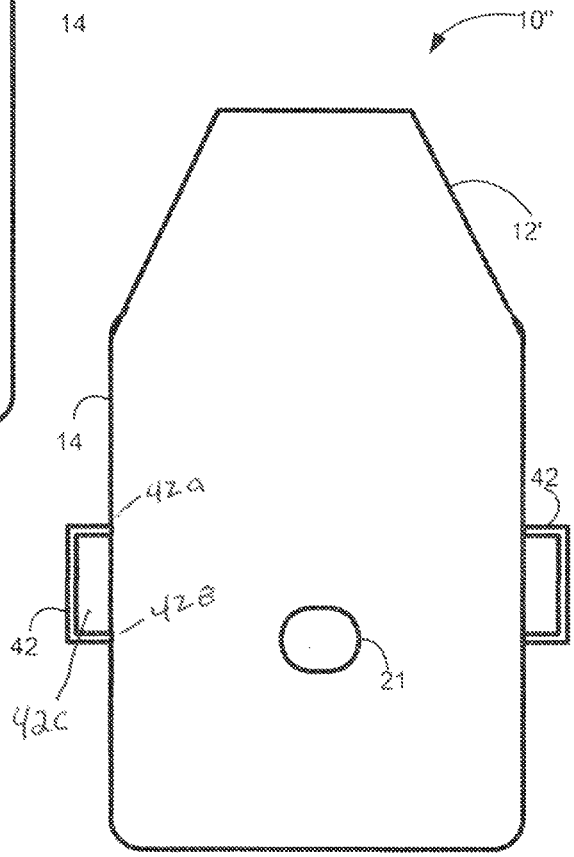
FIG. 4 illustrates a schematic depiction of the care and transfer pad assembly according to another implementation of the principles described here, this implementation including handles.

FIG. 1 illustrates an exemplary pad assembly 10. The pad assembly 10 includes a bead section 12 and a body section 14. The combination of the bead section 12 and the body section 14 has a proximal end 16 and a distal end 18. The head section 12 is generally narrower in width than the body section 14, but the way in which the narrowing is accomplished may vary. A number of exemplary profiles 26 are illustrated, some with a gradual narrowing and others with a more drastic one. FIGS. 3 and 4 illustrate a simple linear taper on pad assemblies 10' and 10" which creates a head section 12', the same being trapezoidal in shape. It will be understood that the narrowing may be along a curve rather than a straight line, or in any other fashion in which the resulting head section is caused to be narrower in width than the body section. It will further be understood that the narrower head section need not have a constant value of width, rather the same may vary along the longitudinal direction, i.e., in the direction from the distal end to the proximal end.

Referring back to FIG. 1, the pad assembly 10 includes a number of additional features. A number of holes 22 and 24 are illustrated. In one preferred embodiment, two holes 22 (illustrated with solid lines) are employed, each on opposite sides of a centerline 11 of the pad assembly, and each at a longitudinal distance along the length of the pad assembly such that the holes are at or adjacent to a center of mass of a baby or toddler placed on the pad assembly 10. It will be understood that "at or adjacent to" is approximate, and that the phrase will generally mean +/−25%, +/−10%, or the like. The holes 24 are optional in some implementations, and generally provide additional location where the body section may be grasped to accomplish transfer of the pad assembly and child. The holes 24 may further be placed at the proximal and distal ends of the combination of the body section and head section, as seen in FIG. 1.

The holes 22 or 24 may be covered by a hole cover 15. The hole cover 15 may be entirely separate or may be sewed on, e.g., along one edge. The hole cover 15 may also be attached to the pad assembly using Velcro strips 17, or may be buttoned on by employing buttons 19.

The pad assembly may also be fitted with various extensions in order to provide a longer pad assembly for larger or older babies and toddlers. For example, referring back to FIG. 1, extension **26*a* is illustrated attached to the body section 14 using a Velcro strip 28*a*. Another extension 26*b* is attached to the extension 26*a* using another Velcro strip 28*b***. It will be understood that Velcro is not required for attaching the extensions, and the same may be attached to the body section and to each other using buttons, snaps, or any other attachment device. It is generally envisioned that for most purposes such attachments will not be necessary.

As may be seen in FIG. 1, the shape of the pad assembly provides a certain contour to match the shape of the baby or toddler. The top of the pad, where the baby will lay his or her head, is narrower, outlining the baby's head. This shape helps to alleviate the issue where the baby or toddler pulls the pad assembly over their face when in use. The pad becomes wider toward the middle of the pad, where the baby or toddler's body will lay, and continues to be the same size (in this implementation) through to the bottom of the pad where the baby's legs and feet will rest. It will be understood that other shapes may also be employed. The pad assembly can comfortably be wrapped around the baby while in use and can double for use as a blanket. Moreover, the pad assembly may find a triple function for use as a nursing cover.

Figure 2:
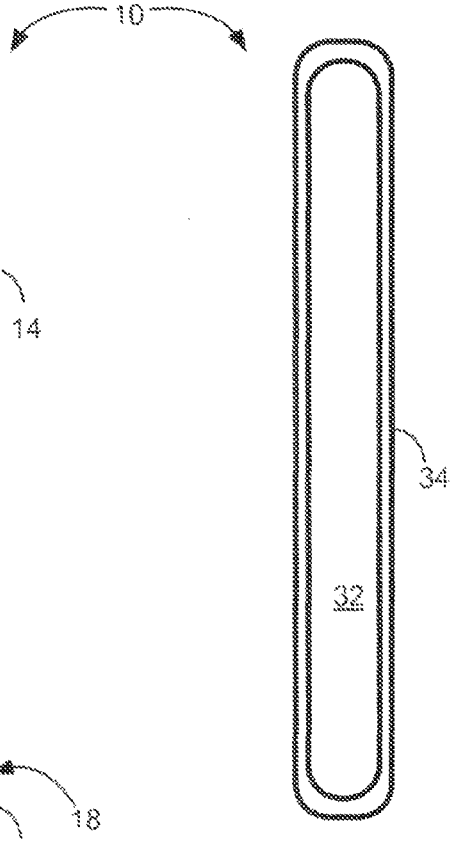
FIG. 2 illustrates a side view of the pad assembly of FIG. 1.

Referring to FIG. 2, it is seen that the pad assembly generally includes an interior core 32 and an outer covering 34. In some cases, the pad assembly may consist of a single layer. Generally, the outer covering 34 may be made of any type of soft material, similar to materials used for baby blankets. For example, such materials include cotton, fleece, flannel, minka, polyester, hemp, rayon, organic materials, any combination of the above, or any other similarly soft breathable material. The materials for any of the components may particularly include flame-retardant or fire proof materials. The inner core material, which in some implementations is stuffed into the outer covering, may include one or more layers of batting material, creating a thickness of 1 to 4 inches thick. Such may be employed to render the pad assembly thick, yet foldable and usable in any of the above disclosed ways, e.g., in a car seat, as a diaper changing pad, or the like. The materials constituting the pad may be made machine washable and dryable for convenience to the user. Additional details of the construction of the pad assembly may be seen below in connection with FIGS. 5 and 6.

Referring to FIG. 4, a pad assembly 10" is illustrated which includes handles 42 disposed on opposite sides of a width of the pad assembly. Such handles may be generally secured towards the middle or bottom of the pad, where a substantial portion of the baby or toddler's weight may be placed. The handles may assist the caregiver while the same picks up the baby as well is when the baby is being transferred to another location. Generally the handles may be made just large enough for hands to fit into. Referring back to FIG. 1, the pad assembly may be made with handle holes in lieu of actual handles. The handle holes may be in a similar placement as handles and maybe used in like manner. The handle holes may have the securing methods noted, to ensure that the limbs of the baby or toddler do not get caught. Velcro or other securing techniques may be employed with handles 42 to fold the same against the pad assembly and to secure the same against ingress by the baby's hands or feet.

Within any of the implementations described, a center hole 21 may be provided through which a strap buckle of a children's car seat may emerge and be coupled to shoulder harnesses. Such a defined hole may be approximately 2"×2", 2"×3", or 3"×3", or as otherwise dictated by the requirements of the harnessing system (both in terms of size and in terms of location). Multiple holes may be employed for this purpose as well. Using this feature as well, a baby may fall asleep in the pad assembly in a car seat and can be removed from the same with a minimum of movement or disturbance, leading to a lessened occurrence of wakening.

Additional details of the pad assembly are now described.

The prototype dimensions of the pad are approximate and will vary according to need. However, it has been found that pads which are approximately 35 to 40 inches in length, e.g., 37 inches, have been found appropriate, where this length includes the length of the body section and the head section. One exemplary width of the body section found to be appropriate is between about 20 and 25 inches, e.g., 21 inches. An exemplary width of the head section is generally less than the width of the body section and may taper or curve, decreasing to a width at a proximal end of between about 13 inches and 21 inches. An exemplary length of the head section is generally less than the length of the body section and may be between about 13 inches and 15 inches. Handles have been found appropriate between about 5 and 10 inches in length, e.g., 8 inches, or in the case of handle slits or holes, 3 to 7 inches have been found appropriate, e.g., 5 inches. The size, width, and length and shape of the pad may be slightly varied, however, the narrower shape toward where the baby will lay his head is an important feature of the pad.

While the pad may have a uniform thickness, in some cases the head section may be made thicker than the body section to provide a pillow effect for the baby's head.

Different prototypes of the shape, width, and length of the pad have been tested, the results indicate that a longer pad is beneficial, so that only one size pad would be needed during the duration of use with a growing baby or toddler. Besides lengthening the pad as shown in FIG. 1, if necessary, Velcro fasteners or another material fastener may be used if a product user wanted a shorter version of the pad or intends to use the pad with a very small infant. The Velcro or other fastener may be secured to one side of the pad towards the bottom, and the pad could be folded up and secured by the Velcro or other fastening material. Upon the baby's growth, the fasteners could be released to grow with the baby such that the pad lengthens to its original size as the baby grows. Using these features reduces or eliminates the need for the pad assembly to be provided in different sizes. Using dimensions as have been disclosed, the pad assembly fits conveniently and easily into a bassinet or car seat, both of which are important applications for the use of the product.

The pad may fold easily and may fold flat, and in this way the handles may act as a carrying tool for the pad, e.g., in a way similar to a purse. Velcro fasteners or other similar fastening devices may be added to secure the pad between the handles for easy insertion into a baby bag.

A consumer may also have the option to use a pad cover. Should the outer material on a pad get lightly soiled, one or more pad covers may be employed as an easy solution to cover up the soiled original pad. The pad covers may also provide the option to change the look and feel of the pad, in that the pad covers may be provided in multiple different colors, patterns, and materials to suit the desires of the user. Having multiple such covers, users may be given the option to not have to be without the pad while the cover for the same is being washed. A new clean cover may simply be placed over the soiled pad for an easy and convenient solution. Of course, it will be understood that such a cover may be used initially in order to prevent soiling of the underlying material.

Figure 5:
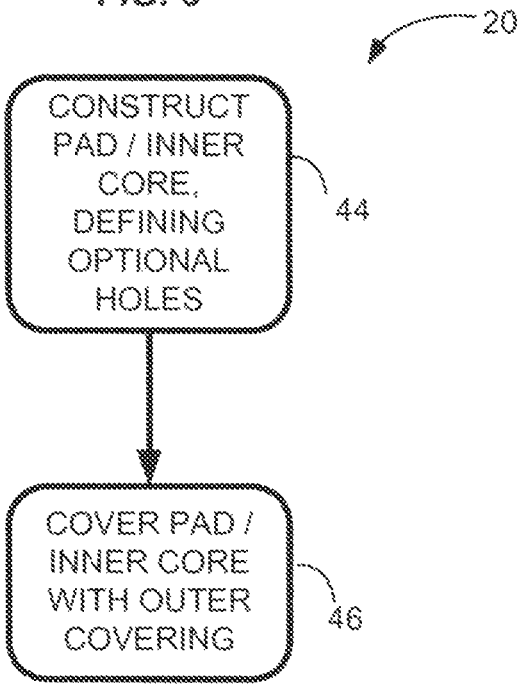
FIG. 5 illustrates a flowchart of a first implementation of a method of manufacturing a pad assembly according to the principles described here.

FIG. 5 illustrates a flowchart 20 of a first implementation of a manufacturing method for a pad assembly. In FIG. 5, a first step is to construct or otherwise manufacture a pad or inner core (step 44). Such may be made of foam or other like material, which is flexible and yet provides a degree of structural integrity such that a child may be lifted in the pad assembly in a secure fashion. The pad or inner core may then be covered with an outer covering (step 46). The outer covering in this case may be, e.g., a rubber or vinyl that is then covered with a cloth material. For example, a pad cover may be employed to protect the pad and outer covering from soiling.

Figure 6:
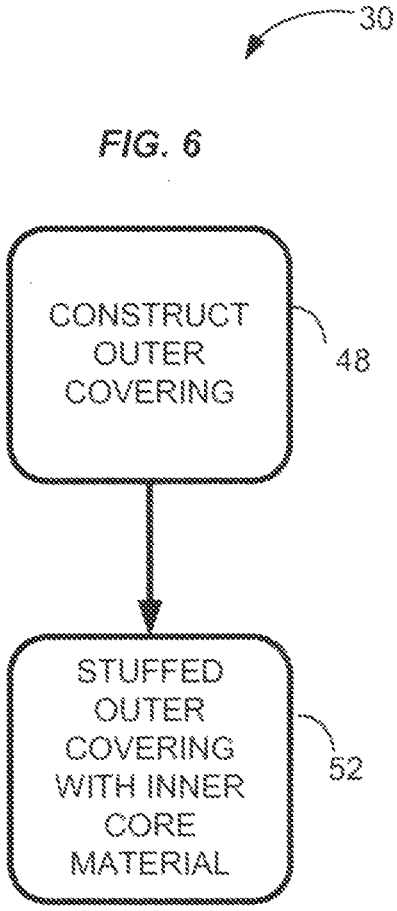
FIG. 6 illustrates a flowchart of a second implementation of a method of manufacturing a pad assembly according to the principles described here.

FIG. 6 illustrates a flowchart 30 of a second implementation of a manufacturing method for a pad assembly. In FIG. 6, a first step is to construct the outer covering (step 48). The outer covering may generally be a cloth or other such material. The outer covering is then stuffed with an inner core material (step 52), such as butting, cotton, or other such materials as described above in reference to FIG. 2.

Those skilled in the art will appreciate that embodiments of the invention may take various forms. For example, the handles 42 described in reference to FIG. 4 may be made of any suitable material including cloth or plastic. The handles are 42 may be attached to the edge or periphery of the pad assembly 10 or to the front or back of the pad assembly 10. Each of the handles 42 are connected to the pad assembly at two points 42*a* and 42*b*. This connection scheme forms a handle opening 42*c* into which a caregiver may insert their hand and by closing their fingers around the handle 42 obtain a secure grasp of the pad. That is, a caregiver may securely grasp the pad by placing their fingers completely around the handle. This allows for safely and easily moving a sleeping baby or toddler. As discussed above, an embodiment of the invention provides hole handles in lieu of the actual handles 42. The hole handles which may be holes such as hole 22 or 24 are actual holes or apertures completely though the pad assembly 10. The holes allow a caregiver to securely grasp the pad by inserting their fingers into the holes and around the material of the edge of the pad so that the caregivers hand completely surrounds the material of the edge of the pad.

While the invention has been described in terms of several embodiments, those skilled in the art will recognize that the invention is not limited to the embodiments described, but can be practiced with modification and alteration within the spirit and scope of the appended claims. The description is thus to be regarded as illustrative instead of limiting.

What is claimed is:

1. A pad assembly for caring for and transferring a baby or toddler, the pad comprising: a body section configured for supporting a body of a baby or toddler, the body section having a body width, a body thickness, and a body length, the body section defining two sides, a portion of each of the two sides defining at least two side holes disposed on opposite sides of the body width, the side holes comprising an aperture completely through the body thickness of the body section of the pad assembly, the side holes configured for grasping by a user such that the user can insert their fingers through the side holes and completely surround a portion of the pad assembly, the side holes having a length of at least three inches, the body section having a centerline equidistant from each of the two sides, the body section sufficiently flexible to be flexed around the centerline such that when in use, the body section can be wrapped around the baby or toddler, the body section having an outer surface comprising a soft breathable material, such that when the body section is wrapped around the body of the baby or toddler, the movement and temperature change of the baby or toddler are reduced during a transfer of the baby or toddler from a first resting place to a second resting place, and wherein the body section further defines a hole along its centerline structured and configured for access of a buckle in a baby or toddler device having a buckle; a head section configured for supporting a head of the baby or toddler, the head section having a head width, a head thickness, and a head length, such that the head width and head length are less than the body width and the body length respectively; and a bottom section configured to support the feet of the baby or toddler, wherein the body section of the pad is wider than the top section and the pad continues to be the same width from the body section through the bottom section of the pad.

* * * * *